United States Patent [19]

Dempsey et al.

[11] Patent Number: 4,956,061

[45] **Date of Patent: * Sep. 11, 1990**

[54] PRODUCTION OF HALOGENS BY ELECTROLYSIS OF ALKALI METAL HALIDES IN AN ELECTROLYSIS CELL HAVING CATALYTIC ELECTRODES BONDED TO THE SURFACE OF A SOLID POLYMER ELECTROLYTE MEMBRANE

[75] Inventors: Russell M. Dempsey, Hamilton; Thomas G. Coker, Waltham; Anthony B. LaConti, Lynnfield; Anthony R. Fragala, North Andover, all of Mass.

[73] Assignee: Oronzio de Nora Permelec S.p.A., Milan, Italy

[ * ] Notice: The portion of the term of this patent subsequent to Sep. 23, 1997 has been disclaimed.

[21] Appl. No.: 224,607

[22] Filed: Jul. 27, 1988

Related U.S. Application Data

[60] Continuation of Ser. No. 153,368, May 27, 1980, Pat. No. 4,772,364, which is a division of Ser. No. 922,316, Jul. 6, 1978, Pat. No. 4,224,121, which is a continuation-in-part of Ser. No. 892,500, Apr. 3, 1978, abandoned, which is a continuation-in-part of Ser. No. 858,959, Dec. 9, 1977, abandoned.

[51] Int. Cl.[5] ..... C25B 1/26

[52] U.S. Cl. ..... 204/128; 204/283; 204/291; 204/292; 204/294

[58] Field of Search ..... 204/98, 128, 291, 294, 204/290 R, 296

[56] References Cited

U.S. PATENT DOCUMENTS 4,039,409 8/1977 LaConti et al. ..... 204/129

4,090,931 5/1978 Motani et al. ..... 204/98

*Primary Examiner*—John F. Niebling

*Assistant Examiner*—Kathryn Gorgos

*Attorney, Agent, or Firm*—Pollock, Vande Sande & Priddy

[57] ABSTRACT

Chlorine is generated by electrolyzing aqueous alkali metal chloride in a cell wherein the anode and cathode are separated by and in contact with an ion exchange diaphragm and wherein the anode and/or cathode contains particles of an electroconductive catalytic material along with particles of an electroconductive extender bonded to the membrane.

12 Claims, 1 Drawing Sheet

PRODUCTION OF HALOGENS BY ELECTROLYSIS OF ALKALI METAL HALIDES IN AN ELECTROLYSIS CELL HAVING CATALYTIC ELECTRODES BONDED TO THE SURFACE OF A SOLID POLYMER ELECTROLYTE MEMBRANE

CROSS REFERENCE TO RELATED APPLICATIONS

This is a continuation of application Ser. No. 153,368 filed on May 27, 1980 now U.S. Pat. No. 4,772,364; which, is a Divisional of Ser. No. 922,316 filed on July 6, 1978 and is now U.S. Pat. No. 4,224,121; which, in turn, is a continuation in part of Ser. No. 892,500 filed on Apr. 3, 1978; which, in turn, is a continuation in part of Ser. No. 858,959 filed on Dec. 9, 1977.

TECHNICAL FIELD

A halogen, such as chlorine, is generated by electrolysis of an aqueous solution of an alkali metal halide such as sodium chloride, in a cell having anolyte and catholyte chambers separated by a solid polymer electrolyte in the form of a stable, selectively cation permeable, ion exchange membrane. One or more catalytic electrodes including at least one thermally stabilized, reduced oxide of a platinum group metal are bonded to the surface of the membrane. An aqueous brine solution is brought into contact with the anode and water or an aqueous NaOH solution is brought into contact with the cathode. The brine is electrolyzed to produce chlorine at the anode and hydrogen and caustic at the cathode. The cell membrane preferably has an anion rejecting cathode side barrier layer which rejects hydroxyl ions to block back migration of caustic to the anode thereby enhancing the cathode current efficiency of the cell and of the process.

This invention relates generally to a process and apparatus for producing halogens and alkali metal hydroxides by electrolysis of aqueous alkali metal halides. More specifically, the invention relates to a process and apparatus for producing chlorine and sodium hydroxide by the electrolysis of brine in a cell utilizing a solid polymer electrolyte membrane having catalytic anodes and cathodes bonded to at least one surface of the membrane.

BACKGROUND ART

Production of halogens such as chlorine through the electrolysis of a sodium chloride solution with caustic (NaOH) as a co-product is a great industry. The Chlor-Alkali industry produces millions of tons of chlorine and caustic soda per year. The principal electrolytic processes by which chlorine has been produced are the so-called mercury cell and diaphragm cell processes. The mercury cell process involves the electrolysis of an alkaline metal chloride solution in a cell between a graphite or metal anode (DSA - Dimensionally Stable Anode). Chlorine is liberated at the anode and the alkali metal is deposited into the mercury in the form of an alkali metal amalgam. The latter is treated in a decomposition reaction in which the amalgam is reacted with water to form caustic soda and hydrogen. However, the mercury cell process for generation of chlorine is, for all practical purposes, now obsolete. Mercury is such a hazardous substance and governmental regulatory provisions for the control of mercury and other types of pollution are becoming so stringent that the days of the mercury cell are over. However, beyond the pollution aspect and the environmental problems associated with the use of mercury cells for chlorine generation, mercury cells are complex and expensive. The use of mercury itself introduces problems relative to the size and complexity of the cell because of the care needed in handling the material. Mercury is expensive and substantial quantities must be used. Not the least of the economic problems with the process is the need for a decomposition step, and the attendant equipment, to produce the caustic soda and hydrogen.

The diaphragm cell on the other hand does not involve the use of mercury, but contains foraminous electrodes separated by a microporous diaphragm. The space between the electrodes is filled with a brine solution and separated by a microporous diaphragm which may take the form of an overlying porous diaphragm which separates the catholyte and anolyte compartments. One of the serious disadvantages of a diaphragm cell is the fact that pores in the diaphragm permit mass transfer or hydraulic flow of sodium chloride solutions across the diaphragm. As a result, the catholyte, i.e., the caustic produced at the cathode contains substantial amounts of sodium chloride. This results in the production of an impure and dilute caustic. On the other hand, hydroxide produced at the cathode can back migrate through the porous separator to the anode where it is electrolyzed producing oxygen. Production of oxygen at the anode is very undesirable for several reasons. Production of oxygen at the anode not only results in low purity chlorine, but also oxygen attacks the anode electrode.

Because the mass transfer of the anolyte and catholyte between the chambers produces so many undesirable effects, a number of arrangements have been proposed to minimize or eliminate these problems - one of these is maintaining a pressure differential across the diaphragm to ensure that the mass transfer of the electrolytes between the anolyte and catholyte chambers is minimized. However, such solutions are at best only partially effective.

In order to overcome the disadvantages associated with the diaphragm cell and the mass transfer of electrolyte across the porous diaphragm, it has been suggested that ionically permselective membranes be utilized in chlorine generating cells to separate the anolyte and catholyte chambers. The permselective membranes used in these cells are typically cationic membranes in that they permit the selective passage of positive cations while minimizing passage of negatively charged anions. Since these membranes are not porous, they do have a tendency to inhibit the back migration of the caustic from the catholyte chamber to the anolyte chamber and similarly to prevent the brine anolyte from being transported to the catholyte chamber and diluting the caustic. It has been found, however, that membrane cells are still subject to certain shortcomings which limit their widespread use. One of the principal shortcomings of the membrane type cell as they are known to date is that they were characterized by high cell voltage. This is only in part due to the membrane characteristic itself. It was in great part due to the fact that the known membrane cell construction utilize electrodes which are physically spaced from the membrane. As a result of the physical spacing between the electrodes and the membrane, the cell, in addition to the IR drop across the membrane, involves electrolyte IR drops in the electrolyte between the electrodes and the membrane prior to ion transport and are also subject to voltage drops due to gas bubble formation or mass transfer effects. That is, since the catalytic electrodes are spaced from the membrane, the chlorine is generated away from the membrane. This results in the formation of a gaseous layer between the electrode and the membrane. This gaseous layer interrupts the electrolyte path between the electrode and the membrane, thereby partially blocking the ions from the membrane. This interruption of the electrolyte path between the electrode and membrane, of course, introduces an additional IR drop which increases the cell voltage required for generation of the chlorine and obviously reduces the voltage efficiency of the cell.

SUMMARY OF INVENTION

It is therefore a primary object of this invention to produce halogens efficiently by electrolysis of an alkali metal halide solution in a cell utilizing a solid polymer electrolyte in the form of an ion exchange membrane.

It is the further object of this invention to provide a method and apparatus for producing chlorine by the electrolysis of aqueous sodium chloride with substantially lower cell voltages.

Yet another object of this invention is to provide a method and apparatus for producing chlorine by the electrolysis of aqueous sodium chloride in which overvoltages at the anode and cathode electrodes are minimized.

Still another object of the invention is to provide a method and apparatus for producing chlorine by the electrolysis of sodium chloride in which the voltage inefficiencies due to electrolyte drop, gas mass transport effects, and the like, are minimized.

Yet a further object of the invention is to provide a method and apparatus for producing high purity chlorine by electrolysis of an aqueous solution sodium chloride in a highly economical and efficient manner.

Other objects and advantages of the invention will become apparent as the description thereof proceeds.

In accordance with the invention, halogens, i.e., chlorine, bromine, etc., are generated by electrolysis of an aqueous alkali metal halide, i.e., an NaCl solution at the anode of an electrolysis cell which includes a solid polymer electrolyte in the form of a cation exchange membrane to separate the cell into catholyte and anolyte chambers. The catalytic electrodes at which the chlorine and caustic are produced are thin, porous, gas permeable catalytic electrodes which are bonded to and embedded in opposite surfaces of the membrane so that the chlorine is generated right at the electrode-membrane interface. This results in electrodes which have very low overvoltages for chlorine discharge and the production of caustic.

The catalytic electrodes include a catalytic material comprising at least one reduced platinum group metal oxide which is thermally stabilized by heating the reduced oxides in the presence of oxygen. In a preferred embodiment, the electrodes are fluorocarbon (polytetrafluoroethylene particles) bonded with thermally stabilized, reduced oxides of a platinum group metal. Examples of useful platinum group metals are platinum, palladium, iridium, rhodium, ruthenium and osmium. The preferred reduced metal oxides for chlorine production are reduced oxides of ruthenium or iridium. The electrocatalyst may be a single, reduced platinum group metal oxide such as ruthenium oxide, iridium oxide, platinum oxide, etc. It has been found, however, that mixtures or alloys of reduced platinum group metal oxides are more stable. Thus, an electrode of reduced ruthenium oxides containing up to 25% of reduced oxides of iridium, and preferably 5 to 25% of iridium oxide by weight has been found very stable. Graphite or another conductive extender, i.e., ruthenized titanium is added in an amount up to 50% by weight, preferably 10–30%. The extender should have good conductivity with a low halogen overvoltage and should be substantially less expensive than platinum group metals, so that a substantially less expensive yet highly effective electrode is possible.

One or more reduced oxides of a valve metal such as titanium, tantalum, niobium, zirconium, hafnium, vanadium or tungsten may be added to stabilize the electrode against oxygen, chlorine and the generally harsh electrolysis conditions. Up to 50% by weight of the valve metal is useful, with the preferred amount being 25–50% by weight. At least one of the catalytic electrodes is bonded to the liquid impervious, ion transporting membrane. By bonding one or both of the electrodes to the membrane "electrolyte IR" drop between the electrodes and the membrane is minimized as is gas mass transport loss due to the formation of a gaseous layer between the electrode and the membrane. This results in a substantial reduction in the cell voltage and the important economic benefits that flow from this reduction.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

BEST AND VARIOUS EMBODIMENTS FOR CARRYING OUT INVENTION

Figure 1:
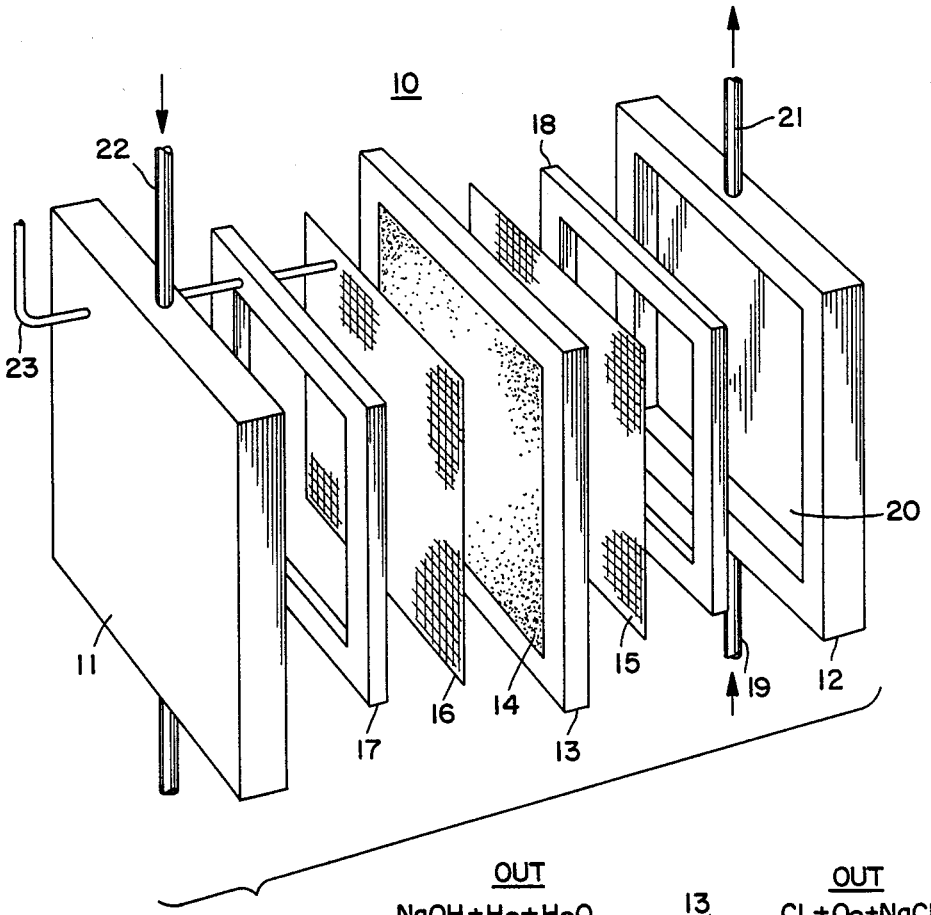
FIG. 1 is a diagramatic illustration of an electrolysis cell constructed in accordance with the invention.

Referring now to FIG. 1, the electrolysis cell is shown generally at 10 and consists of a cathode compartment 11, an anode compartment 12, separated by a solid polymer electrolyte membrane 13 which is preferably a hydrated, perm-selective cationic membrane. Bonded to anode surfaces of membrane 13 are electrodes comprising particles of a fluorocarbon, such as the one sold by the Dupont Company under its trade designation "Teflon", bonded to stabilized, reduced oxides of ruthenium, ($RuO_x$), or iridium, ($IrO_x$), stabilized reduced oxides of ruthenium-iridium $(RuIr)O_x$, ruthenium-titanium $(RuTi)O_x$, ruthenium-titanium-iridium $(RuTiIr)O_x$, ruthenium-tantalum-iridium $(RuTaIr)O_x$ or ruthenium-graphite. The cathode, shown at 14, is bonded to and embedded in one side of the membrane and a catalytic anode, not shown, is bonded to and embedded in the opposite side of the membrane. The Teflon-bonded cathode is similar to the anode catalyst. Suitable catalyst materials include finely divided metals of platinum, palladium, gold, silver, spinels, manganese, cobalt, nickel, reduced Pt-group metal oxides Pt-Ir $O_x$, Pt-Ru $O_x$, graphite and suitable combinations thereof.

Current collectors in the form of metallic screens 15 and 16 are pressed against the electrodes. The whole membrane/electrode assembly is firmly supported between the housing elements 11 and 12 by means of gaskets 17 and 18 which are made of any material resistant to or inert to the cell environment, namely chlorine, oxygen, aqueous sodium chloride and caustic. One form of such a gasket is a filled rubber gasket sold by the Irving Moore Company of Cambridge, Massachusetts under its trade designation EPDM. The aqueous brine anolyte solution is introduced through an electrolyte inlet 19 which communicates with anode chamber 20. Spent electrolyte and chlorine gas are removed through an outlet conduit 21 which also passes through the housing. A cathode inlet conduit 22 communicates with cathode chamber 11 and permits the introduction of the catholyte, water, or aqueous NaOH (more dilute than that formed electrochemically at electrode/electrolyte interface) into the cathode chamber. The water serves two separate functions. A portion of the water is electrolyzed to produce hydroxyl ($OH^-$) anions which combine with the sodium cations transported against the membrane to form caustic (NaOH). It also sweeps across the embedded cathode electrode to dilute the highly concentrated caustic formed at the membrane/electrode interface to minimize diffusion of the caustic back across the membrane into the anolyte chamber. Cathode outlet conduit 23 communicates with cathode chamber 11 to remove the diluted caustic, plus any hydrogen discharged at the cathode and any excess water. A power cable 24 is brought into the cathode chamber and a comparable cable, not shown, is brought into the anode chamber. The cables connect the current conducting screens 15 and 16 to a source of electrical power.

Figure 2:
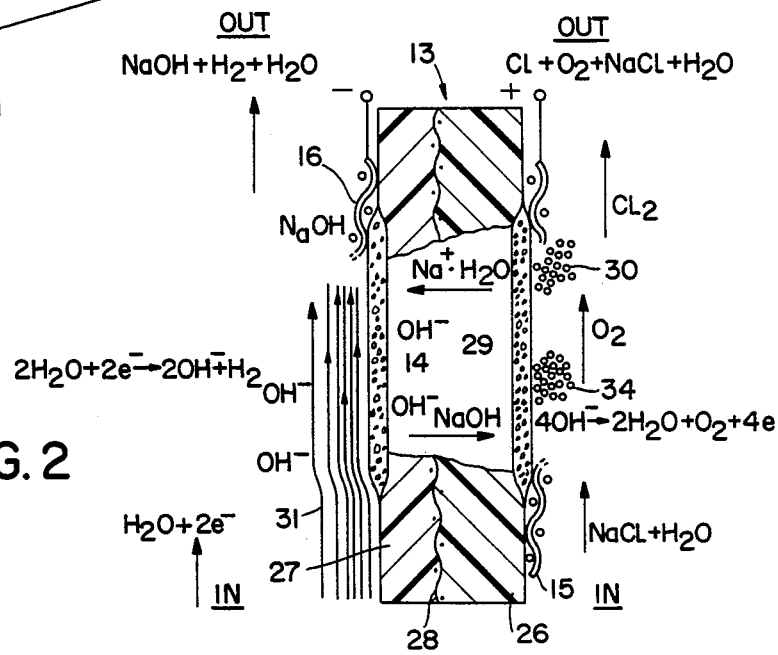
FIG. 2 is a schematic illustration of the cell and the reactions taking place in various portions of the cell.

FIG. 2 illustrates diagramatically the reactions taking place in the cell during brine electrolysis, and is useful in understanding the electrolysis process and the manner in which the cell functions. An aqueous solution of sodium chloride is brought into the anode compartment which is separated from the cathode compartment by the cationic membrane 13. In order to optimize cathodic efficiency, membrane 13 is provided with a cathode side, ion rejecting barrier layer to reject hydroxyl ions and block or minimize back migration of the caustic to the anode. Membrane 13, as will be explained in detail later, is a composite membrane made up of a high water content (20–35% based on dry weight of membrane) layer 26, on the anode side and a low water content (5–15% based on dry weight of membrane) cathode side layer 27, separated by a Teflon cloth 28. The rejection characteristics of the cathode side anion rejecting barrier layer may be enhanced further by chemically modifying the perfluorosulfonic acid membrane on the cathode side to form a thin layer of a low water content polymer. In one form, this is achieved by modifying the polymer to form a substituted sulfonamide membrane layer. Thus, cathode side layer 27 has a high MEW or is converted to a weak acid form (sulfonamide), thus reducing the water content of this portion of the laminated membrane. This increases the salt rejection capability of the film and minimizes diffusion of sodium hydroxide back across the membrane to the anode. The membrane may also be a homogenous film of a low water content membrane (Nafion-150, perfluorocarboxylic, etc.).

Teflon-bonded reduced noble metal oxide catalyst containing stabilized reduced oxides of ruthenium or iridium or ruthenium-iridium with or without reduced oxides of titanium, niobium or tantalum and graphite are, as shown, pressed into the surface of membrane 13. Current collectors 15 and 16, only partially shown for the sake of clarity, are pressed against the surface of the catalytic electrodes and are connected, respectively, to the positive and negative terminals of the power source to provide the electrolyzing potential across the cell electrodes. The sodium chloride solution brought into the anode chamber is electrolyzed at anode 29 to produce chlorine right at the surface as shown diagramatically by the bubble formation 30. The sodium ions ($Na^+$) are transported across membrane 13 to cathode 14. A stream of water or aqueous NaOH shown at 31 is brought into the cathode chamber and acts as a catholyte. The aqueous stream is swept across the surface of Teflon-bonded catalytic cathode 14 to dilute the caustic formed at the membrane/cathode interface and reduce diffusion of the caustic back across the membrane to the anode.

A portion of the water catholyte is electrolyzed at the cathode in an alkaline reaction to form hydroxyl ions ($OH^-$) and gaseous hydrogen. The hydroxyl ions combine with the sodium ions transported across the membrane to produce sodium hydroxide (caustic soda) at the membrane/electrode interface. The sodium hydroxide readily wets the Teflon forming part of the bonded electrode and migrates to the surface where it is diluted by the aqueous stream sweeping across the surface of the electrode. With a cathode aqueous sweep, concentrated sodium hydroxide in the range of 4.5–6.5M is readily produced at the cathode. Thus, even with dilution some sodium hydroxide as shown in the arrow 33 migrates back through membrane 13 to the anode. Sodium hydroxide transported to the anode is oxidized to produce water and oxygen as shown by bubble formation at 34. This, of course, is a parasitic reaction which reduces the cathode current efficiency. The production of oxygen itself is undesirable since it can have troublesome effects on the electrode and the membrane. In addition, the oxygen dilutes the chlorine produced at the anode so that processing is required to remove the oxygen. The reactions in various portions of the cell are as follows:

| | | |
|---|---|---|
| At the Anode (Principal) | $2\,Cl \rightarrow Cl_2 \uparrow + 2e^-$ | (1) |
| Membrane Transport | $2Na^+ + H_2O$ | (2) |
| At the Cathode | $2H_2O \rightarrow 2OH^- + H_2 \uparrow - 2e$ | (3a) |
| | $2Na^+ + 2OH^- \rightarrow 2NaOH$ | (3b) |
| At the Anode (Parasitic) | $4OH^- \rightarrow O_2 + 2H_2O + 4e^-$ | (4) |
| Over All (Principal) | $2NaCl + 2H_2O \rightarrow 2NaOH + Cl_2 + H_2$ | (5) |

The novel arrangement for electrolyzing aqueous solutions of brine which is described herein is characterized by the fact that the catalytic sites in the electrodes are in direct contact with the cation membrane and the ion exchanging acid radicals attached to the polymer backbone (whether these radicals are the $SO_3H \times H_2O$ sulfonic radicals or the $COOH \times H_2O$ carboxylic acid radicals). Consequently, there is no IR drop to speak of in the anolyte or the catholyte fluid chambers (this IR drop is usually referred to as "Electrolyte IR drop"). "Electrolyte IR drop" is characteristic of existing systems and processes in which the electrode and the membrane are separated and can be in the order of 0.2 to 0.5 volts. The elimination or substantial reduction of this voltage drop is, of course, one of the principal advantages of this invention since it has an obvious and very significant effect on the overall cell voltage and the economics of the process. Furthermore, because chlorine is generated directly at the anode and membrane interface, there is no IR drop due to the so-called "bubble effect" which is a gas blinding and mass transport loss due to the interruption or blockage of the electrolyte path between the electrode and the membrane. As pointed out previously, in prior art systems, the chlorine discharging catalytic electrode is separated from the membrane. The gas is formed directly at the electrode and results in a gas layer in the space between the membrane and the electrode. This in effect breaks up the electrolyte path between the electrode-collector and the membrane blocking passage of $Na^+$ ions and thereby, in effect, increasing the IR drop.

ELECTRODES

The Teflon-bonded catalytic electrode contains reduced oxides of the platinum group metals referred to previously such as ruthenium, iridium or ruthenium-iridium in order to minimize chlorine overvoltage at the anode. The reduced ruthenium oxides are stabilized against chlorine and oxygen evolution to produce an anode which is stable. Stabilization is effected initially by temperature (thermal) stabilization; i.e., by heating the reduced oxides of ruthenium at a temperature below that at which the reduced oxides begin to be decomposed to the pure metal. Thus, preferably the reduced oxides are heated at 350°-750° C. from thirty (30) minutes to six (6) hours with the preferable thermal stabilization procedure being accomplished by heating the reduced oxides for one hour at temperatures in the range of 550° to 600° C. The Teflon-bonded anode containing reduced oxides of ruthenium is further stabilized by mixing it with graphite and/or mixing with reduced oxides of other platinum group metals such as iridium $O_x$ in the range of 5 to 25% or iridium, with 25% being preferred, or platinum rhodium, etc., and also with reduced oxides of valve metals such as titanium $(Ti)O_x$, with 25-50% of $TiO_x$ preferred, or reduced oxides of tantalum (25% or more). It has also been found that a ternary alloy of reduced oxides of titanium, ruthenium and iridium $(Ru, Ir, Ti)O_x$ or tantalum, ruthenium and iridium $(Ru, Ir, Ti)O_x$ or tantalum, ruthenium and iridium $(Ru, Ir, Ta)O_x$ bonded with Teflon is very effective in producing a stable, long-lived anode. In case of the ternary alloy, the composition is preferably 5% to 25% by weight of reduced oxides of iridium, approximately 50% by weight reduced oxides of ruthenium, and the remainder a transition metal such as titanium. For a binary alloy of reduced oxides of ruthenium and titanium, the preferred amount is 50% by weight of titanium with the remainder ruthenium. Titanium, of course, has the additional advantage of being much less expensive than either ruthenium or iridium, and thus is an effective extender which reduces cost while at the same time stabilizing the electrode in an acid environment and against chlorine and oxygen evolution. Other transition metals such as niobium (Nb), tantalum (Ta), zirconium (Zr) or hafnium (Hf) can readily be substituted for Ti in the electrode structures.

The alloys of the reduced noble metal oxides along with the reduced oxides of titanium or other transition metals are blended with Teflon to form a homogenous mix. The anode Teflon content may be 15 to 50% by weight of the Teflon, although 20 to 30% by weight is preferred. The Teflon is of the type as sold by the Dupont Corporation under its designation T-30, although other fluorocarbons may be used with equal facility. Typical noble metal, etc., loadings for the anode are 0.6 $mg/cm^2$ of the electrode surface with the preferred range being 1-2 $mg/cm^2$. The current collector for the anode electrode may be a platinized niobium screen of fine mesh which makes good contact with the electrode surface. Alternatively, an expanded titanium screen coated with ruthenium oxide, iridium oxide, transition metal oxide and mixtures thereof may also be used as an anode collector structure. Yet another anode collector structure may be in the form of noble metal or noble metal oxide clad screen attached to the plate by welding or bonding.

The anode current collector which engages the bonded anode layer has a higher chlorine overvoltage than the electrode catalytic anode surface layer. This reduces the probability of electrochemical reaction such as chlorine evolution taking place on the current distributor surface since these reactions are more likely to occur on the electrocatalytic anode electrode surface because of its lower overvoltage and because of the higher IR drop to the collector screen.

The cathode is preferably a bonded mixture of Teflon particles and platinum black with platinum black loading of 0.4 to 4 $mg/cm^2$. As pointed out previously, other catalytic materials such as palladium, gold, silver, spinels, manganese, cobalt, nickel, graphite as well as the reduced oxides used (on the anode, Ru Ir $O_x$, etc.) may be used with equal facility. The cathode electrode, like the anode, is preferably bonded to and embedded in the surface of the cation membrane. The cathode is made quite thin, 2-3 mils or less, and preferably approximately 0.5 mils, is porous and has a low Teflon content.

The thickness of the cathode can be quite significant. It can be reflected in reduced water or aqueous NaOH sweeping and penetration of the cathode and thus reduces cathodic current efficiency. Cells were constructed with thin (approximately 0.5 to 2.0 mil) pt black - 15% Teflon bonded cathodes. The current efficiencies of thin cathode cells were approximately 80% at 5M NaOH when operated at 88°-91° C. with a 290 g/L NaCl anode feed. With a 3.0 mil Ru - graphite cathode, the current efficiency was reduced to 54% at 5M NaOH. Table A shows the relationship to CE to thickness, and indicates that thicknesses not exceeding 2-3 mils give the best performance.

TABLE A

| Cell | Cathode | Cathode Thickness (mil) | Current Efficiency % (M NaOH) |
|---|---|---|---|
| 1 | Pt Black | 2-3 | 64 (4.0 M) |
| 2 | Pt Black | 2-3 | 73 (4.5 M) |
| 3 | Pt Black | 1-2 | 75 (3.1 M) |
| 4 | Pt Black | 1-2 | 82 (5 M) |
| 5 | Pt Black | 0.5 | 78 (5.5 M) |
| 6 | 5% Pt Black Graphite | 3 | 78 (3.0 M) |
| 7 | 15% Ru $O_x$ on Graphite | 3 | 54 (5.0 M) |
| 8 | Platinized Graphite Cloth | 10-15 | 57 (5 M) |

The electrode is made gas permeable to allow gases evolved at the electrode/membrane interface to escape readily. It is made porous to allow penetration of the sweep water to the cathode electrode/membrane interface where the NaOH is formed and to allow brine feedstock ready access to the membrane and the electrode catalytic sites. The former aids in diluting the highly concentrated NaOH when initially formed before the NaOH wets the Teflon and rises to the electrode surface to be further diluted by water sweeping across the electrode surface. It is important to dilute at the membrane interface where the NaOH concentration is the greatest. In order to maximize water penetration at the cathode, the Teflon content should not exceed 15% to 30% weight, as Teflon is hydrophobic. With good porosity, a limited Teflon content, a thin cross-section, and a water or diluted caustic sweep, the NaOH concentration is controlled to reduce migration of NaOH across the membrane. In addition to controlling the structural characteristics of the cathode and utilizing a water or diluted caustic sweep to reduce NaOH concentration, back migration of the caustic can be further reduced by providing an anion rejecting barrier layer on the cathode side.

The current collector for the cathode must be carefully selected since the highly corrosive caustic present at the cathode attacks many materials, especially during shutdown. The current collector may take the form of a nickel screen since nickel is resistant to caustic. Alternatively, the current collector may be constructed of a stainless steel plate with a stainless steel screen welded to the plate. Another cathode current structure which is resistant to or inert in the caustic solution is graphite or graphite in combination with a nickel screen pressed to the plate and against the surface of the electrode. The cathode current collector which engages the bonded cathode layer is fabricated of materials which have a higher hydrogen overvoltage than the electrocatalytic cathode surface. This also reduces the probability of an electrochemical reaction such as hydrogen evolution taking place on the current distributor since these reactions are more likely to occur on the electrocatalytic cathode electrode surface because of its lower overvoltage and because the cathode electrode also, to some extent, screens the collector.

MEMBRANE

Membrane 13 is preferably a stable, hydrated, cationic membrane which is characterized by ion transport selectivity. The cation exchange membrane allows passage of positively charged sodium cations and minimizes passage of negatively charged anions. There are various types of ion exchange resins which may be fabricated into membranes to provide selective transport of the cation. Two classes of such resins are the so-called sulfonic acid cation exchange resins and the carboxylic cation exchange resins. In the sulfonic acid exchange resins, which are the preferred type, the ion exchange groups are hydrated sulfonic acid radicals ($SO_3H \times H_20$) which are attached to the polymer backbone by sulfonation. The ion exchanging acid radicals are not mobile within the membranes, but are fixedly attached to the backbone of the polymer ensuring that the electrolyte concentration does not vary.

As pointed out previously, perfluorocarbon sulfonic acid cation membranes are preferred as they provide excellent cation transport, they are highly stable, they are not affected by acids and strong oxidants, they have excellent thermal stability, and they are essentially invariant with time. One specific class of cation polymer membranes which is preferred is sold by the Dupont Company under its trade designation - "Nafion", and these membranes are hydrated, copolymers of polytetrafluoroethylene (PTFE) and polysulfonyl fluoride vinyl ether containing pendant sulfonic acid groups. These membranes may be used in hydrogen form which is customarily the way they are obtained from the manufacturer. The ion exchange capacity. (IEC) of a given sulfonic cation exchange membrane is dependent upon the milli-equivalent weight (MEW) of the $SO_3$ radical per gram of dry polymer. The greater the concentration of the sulfonic acid radicals, the greater the ion exchange capacity and hence the capability of the hydrated membrane to transport cations. However, as the ion exchange capacity of the membrane increases, so does the water content and the ability of the membrane to reject salts decreases. The rate at which sodium hydroxide migrates from the cathode to the anode side thus increases with IEC. This results in a reduction of the cathodic current efficiency (CE) and also results in oxygen generation at the anode with all the undesirable results that accompany that. Consequently, one preferred ion exchange membrane for use in brine electrolysis is a laminate consisting of a thin (2 mil thick) film of 1500 MEW, low water content (5–15%) cation exchange membrane, which has high salt rejection, bonded to a 4 mil or more film of high ion exchange capacity, 1100 MEW, with a Teflon cloth. One form of such a laminated construction is sold by the Dupont Company and its trade designation is Nafion 315. Other forms of laminates or constructions are available, Nafion 355, 376, 390, 227, 214, in which the cathode side consists of thin layer or film of low-water content resin (5 to 15%) to optimize salt rejection, whereas the anode side of the membrane is a high-water content film to enhance ion exchange capacity.

The ion exchange membrane is prepared by soaking in caustic (3 to 8M) for a period of one hour to fix the membrane water content and ion transport properties. In the case of a laminated membrane bonded together by a Teflon cloth, it may be desirable to clean the membrane or the Teflon cloth by refluxing it in 70% $HNO_3$ for three to four hours.

As has been pointed out briefly before, the cathode side barrier layer should be characterized by low-water content on a water absorption persulfonic acid group basis. This results in more efficient anion (hydroxyl) rejection. By blocking or rejecting the hydroxyl ions, back migration of the caustic is substantially reduced, thereby increasing the current efficiency of the cell and reducing oxygen generation at the anode. In an alternative laminate construction, the cathode side layer of the membrane is chemically modified. The functional groups at the surface layer of the polymer are modified to have lower water absorption than the membrane in the sulfonic acid form. This may be achieved by reacting a surface layer of the polymer to form a layer of sulfonamide groups. There are various reactions which can be utilized to form the sulfonamide surface layer. One such procedure involves reacting the surface of the Nafion membrane while in the sulfonyl fluoride form with amines such as ethelynediamine (EDA) to form the substituted sulfonamide membranes. This sulfonamide layer acts as a very effective barrier layer for anions. By rejecting the hydroxyl anions on the cathode side, obviously back migration of the caustic (NaOH) is substantially reduced.

ELECTRODE PREPARATION

The reduced, platinum group metal oxides of ruthenium, iridium, rutheniumiridium, etc., with and without the reduced oxides of the transition metals such as titanium or of graphite which are bonded with the Teflon particles to form the porous, gas permeable, catalytic electrodes, are prepared by thermally decomposing mixed metal salts in the absence or presence of excess sodium salts, i.e., nitrates, carbonates, etc. The actual method of preparation is a modification of the Adams method of platinum preparation by the inclusion of thermally decomposable halides of iridium, titanium, or ruthenium, i.e., salts of these metals such as iridium chloride, ruthenium chloride, or titanium chloride. As one example, in the case of (ruthenium, iridium)$O_x$ binary alloy the finely divided salts of ruthenium and iridium are mixed in the same weight ratio of ruthenium and iridium as desired in the alloy. An excess of sodium nitrate or equivalent alkali metal salts is incorporated and the mixture fused in a silica dish at 500° C. to 600° C. for three hours. The residue is washed thoroughly to remove the nitrates and halides still present. The resulting suspension of mixed and alloyed oxides is reduced at room temperature by using an electrochemical reduction technique, or, alternatively, by bubbling hydrogen through the mixture. The produce is dried thoroughly, ground and sieved through a nylon mesh screen. Typically after sieving, the particles have a 37 micron ($\mu$) diameter.

The alloy of the reduced oxides of ruthenium and iridium are then thermally stabilized by heating for one hour at 500°to 600° C. The electrode is prepared by mixing the reduced, thermally stabilized platinum group metal oxides with the "Teflon" polytetrafluoroethylene particles. One suitable form of these particles is sold by Dupont under its designation Teflon T-30.

The reduced noble metal oxides such as $RuO_x$ can be blended with a conductive carrier such as graphite, transition metal carbides, transition metals to improve stability and allow low noble metal loadings (0.5 mg/cm$^2$) to be used.

In the graphite-ruthenium case, the powdered graphite (such as Poco graphite 1748 - Union Oil Co.) is mixed with 15–30% of Telflon (T-30). The reduced metal oxides are blended with the graphite-Teflon mix.

The mixture of the noble metal particles and Teflon particles or of graphite and the reduced oxide particles are placed in a mold and heated until the composition is sintered into a decal form which is then bonded to and embedded in the surface of the membrane by the application of pressure and heat. Various methods may be used to bond and embed the electrode into the membrane, including the one described in detail in U.S. Pat. No. 3,134,697 entitled "Fuel Cell", issued May 26, 1964 in the name of Leonard W. Niedrach and assigned to the General Electric Company, the assignee of the instant invention. In the process described therein, the eletrode structure is forced into the surface of a partially polymerized ion exchange membrane, thereby integrally bonding the sintered, porous, gas absorbing particle mixture to the membrane and embedding it in the surface of the membrane.

PROCESS PARAMETERS

Chlorine generation takes place by introducing an aqueous alkali chloride solution such as (NaCl) into the anolyte chamber. The feed rate is prererably in the range of 200 to 2000 cc per minute/per ft$^2$/100 ASF). The brine concentration should be maintained in the range of 2.5 to 5M (150 to 300 grams/liter) with a 5 molar solution at ~300 grams per liter being preferred as the cathodic current efficiency increases directly with concentration. At the same time, increasing the brine concentration reduces oxygen evolution at the anode due to water electrolysis. As the concentration of the anolyte decreases, oxygen evolution is increased because the relative amount of water present at the anode which competes with the NaCl for catalytic reaction sites is increased. As a result, additional water is electrolyzed with the production of oxygen at the anode. Electrolysis of water at the anode also lowers cathodic efficiency because the hydrogen ions $H^+$ produced by the electrolysis of water migrate across the membrane and combine with hydroxyl ions ($OH^-$) to form water instead of utilizing these hydroxyl ions to form caustic.

Maintaining the flow rate into the anolyte chamber within the range described ensures that the anode is continually supplied with fresh feedstock.

If the feed rate is reduced, the residence time of the feedstock, and particularly the residence time of the depleted brine feedstock, increases. The depleted feedstock with its relative high water content is present longer at the anode and this tends to increase water electrolysis with the attendant production of oxygen and transport of hydrogen ions across the membrane. Thus, both the concentration level of the brine as well as the feed rate affect the evolution of oxygen at the anode and the transport of hydrogen ions across the membrane.

It may also be desirable to conduct the electrolysis at super atmospheric pressures to enhance removal of gaseous electrolysis products. Pressurizing the anolyte and catholyte compartments, above atmospheric, reduces the size of gas bubbles formed at the electrodes.

The smaller gas bubbles are much more readily detached from the electrode and the electrode surface thereby enhancing removal of the gaseous electrolysis products from the cell. There is an additional benefit in that it tends to eliminate or minimize formation of gas films at the electrode surface; films which can block ready access of the anolyte and catholyte solutions to the electrode. In a hybrid cell arrangement where only one electrode is bonded to the membrane, reduction of bubble size reduces gas blinding and mass transfer losses (IR drop due to "bubble effect") in the space between the non-bonded electrode and the membrane because interruption of the electrolyte path is less with smaller bubbles.

OXYGEN EVOLUTION

Oxygen evolution at the anode due to electrolysis of water may, as pointed out above, be minimized by maintaining flow rates in the range described, and by maintaining the brine concentration high. However, oxygen may also be generated at the anode due to back migration of sodium hydroxide from the cathode. The NaOH migrates across the membrane due to the high concentration gradient at the membrane interface and the limited capacity of cationic membranes to reject salts which, as was pointed out previously, is a function of the water content of the membrane. For a 5M NaOH solution, as much as 5 to 30% by weight of the sodium hydroxide formed as the cathode migrates back across the membrane, depending on the membrane used. Oxygen is produced at the anode by electrochemical oxidation of $OH^-$ in accordance with the following reaction:

$$4OH^- \rightarrow 2H_2O + O_2 + 4e^-$$

The volume percent of oxygen produced at the anode due to caustic migration is roughly one-half of the weight percent of caustic. Thus, 2½ to 15% by volume of oxygen will evolve if 5 to 30% by weight of cuastic migrates to the anode. As pointed out previously, migration of the caustic to the anode can be limited by using a laminated or other membrane in which the cathode side of the membrane is a layer or film of high equivalent weight, low-water content, cationic resin which increases anion (hydroxyl) rejecting capability of the membrane.

However, besides minimizing cuastic transport across the membrane by enhancing the membrane salt rejection capacity, oxygen production at the anode may be further reduced by acidifying the brine solution. The hydrogen ions ($H^+$). from the acidified brine combine with the hydroxyl ($OH^-$) ions and this prevents the oxidation of the hydroxyl ions. Oxygen evolution can be reduced by an order of magnitude or more (from 5 to 10 volume percent of oxygen to 0.2–0.4 volume percent) by addition of at least 0.25 Molar HCl. If the HCl is less concentrated than 0.25M HCl, oxygen evolution rises rapidly from 0.2–0.4 volume percent to normally observed levels, i.e., from 5 to 10 volume percent.

For optimum operation of the process and the cell, brine purity must be high, i.e., $Ca^{++}$, $Mg^{++}$ content must be low. The calcium and magnesium ion content should be maintained at 0.5 PPM or less in order to avoid degradation of the membrane due to calcium and the magnesium ions in the feed brine exchanging into the membrane. Any concentration above 20 PPM results in cell performance being seriously affected within days. As a result, the brine must be purified to maintain the total content at less than 2 PPM and preferably at less than 0.5 PPM.

At 300 ASF, the operating voltage of the bonded electrode type cells is 2.9–3.6 volts, depending on electrode composition, and the feedstock is preferably maintained at a temperature from 80° to 90° C. since the cell voltage and overall efficiency of the cell is substantially improved at the higher operating temperatures. For example, a cell operating at 300 ASF, and utilizing a Teflon-bonded reduced oxide of ruthenium-iridium mixture was operated at various temperatures. At 90° C., the cell voltage was 3.02 volts. For the same cell operating at 35° C. temperature, the cell voltage rose to 3.6 volts. A cell operated at 200 amperes per square foot and at 90° C. required a cell voltage of 2.6 volts. At the same current density, but operating at 35° C., the cell voltage rose to 3.15. Thus, a temperature range of 80° to 90° C. is preferred from an overall operating efficiency standpoint. Although, as shown above, the cell voltage drops at lower current densities, operation at 300 amperes per square foot or greater is preferred since operation at these current densities results in economies in terms of capital investment, i.e., size and cost of a plant required to generate a given tonage of chlorine and/or caustic per day.

The materials of which the cell is constructed are those materials which are resistant or inert to brine and chlorine in case of the anolyte chamber and are resistant to the high concentration caustic and hydrogen in the catholyte chamber. Thus, the end plates cell may be fabricated of pure titanium or stainless steel, the gaskets of a filled rubber type, such as EPDM. The anode current collectors, as described previously, may be fabricated of platinized niobium screens, titanium expanded screens coated with $RuO_x$, $IrO_x$, transition metal oxides and mixtures thereof attached to a titanium plate, or a bonded noble metal or noble metal oxide clad screen attached to a palladium-titanium plate. The cathode current collector may be a nickel, mild steel, or stainless steel plate with a stainless steel screen welded to it, or a plate with a nickel screen fastened to the plate. Other materials such as graphite which are resistant or inert to caustic and are not subject to hydrogen embrittlement may be used in fabricating the cathode current collector.

As pointed out previously, these current collector materials all have higher hydrogen overvoltages in the case of the cathode, or chlorine overvoltages in the case of the anode, so that the electrochemical reaction such as hydrogen and/or chlorine evolution take place perferentially at the electrode catalytic surfaces, and particularly at the interface between these electrocatalytic anodes and the membrane.

EXAMPLES

Cells incorporating ion exchange membranes having Teflon-bonded reduced noble metal oxide electrodes embedded in the membrane were built and tested to illustrate the effect of various parameters on the effectiveness of the cell in brine electrolysis and to illustrate particularly the operating voltage characteristics of the cell.

Table I illustrates the effect on cell voltage of the various combinations of the reduced noble metal oxides. Cells were constructed with electrodes containing various specific combinations of reduced noble metal oxides bonded to Teflon particles and embedded into a cationic membrane 6 mils thick. The cell was operated with a current density of 300 amperes per square foot at 90° C., at feed rates of 200 to 2000 CC per minutes, with feed concentration of 5M.

One cell was constructed in accordance with the teachings of the prior art and contained a dimensionally stabilized anode spaced from the membrane and a stainless steel cathode screen similarly spaced. This control cell was operated under the same conditions.

It can readily be observed from this data that in the process of the instant invention, the cell operating potentials are in the range of 2.9–3.6 volts. When compared to a typical prior art arrangement (Control Cell No. 4), under the same operating conditions, a voltage improvement of 0.6 V–1.5 V is realized. The operating efficiencies and economic benefits which result are clearly apparent.

TABLE I

| Cell No. | Anode | Cathode | Brine Feed | Current Density (ASF) | Cell Voltage (V) | T.°-C.° | C.E. | Membrane (5M NaOH) |
|---|---|---|---|---|---|---|---|---|
| 1 | 6 Mg/Cm$^2$ (Ru 25% Ir)$O_x$ | 4 Mg/Cm$^2$ Pt Black | ~5M (290 g/L) | 300 | 3.2–3.3 | 90° | 85% | Dupont Nafion 315 Laminate |
| 2 | 6 Mg/Cm$^2$ (Ru 25% Ir)$O_x$ | 4 Mg/Cm$^2$ Pt Black | ~5M (290 g/L) | 300 | 3.3–3.6 | 90° | 78% | Dupont 1500 EW Nafion |

TABLE I-continued

| Cell No. | Anode | Cathode | Brine Feed | Current Density (ASF) | Cell Voltage (V) | T.°-C.° | C.E. | Membrane (5M NaOH) |
|---|---|---|---|---|---|---|---|---|
| 3 | 6 Mg/Cm$^2$ (Ru 25% Ir)$O_x$ | 4 Mg/Cm$^2$ Pt Black | ~5M (290 g/L) | 300 | 2.9 | 90° | 66% | Dupont 1500 EW Nafion |
| 4 | Dimensionally Stable Screen Anode - Spaced from Membrane | Stainless Steel Screen Spaced from Membrane | ~5M (290 g/L) | 300 | 4.2–4.4 | 90° | 81% | Dupont 1500 EW Nafion |
| 5 | 4 Mg/Cm$^2$ (Ru 50% Ti)$O_x$ | 4 Mg/Cm$^2$ Pt Black | ~5M (290 g/L) | 300 | 3.6–3.7 | 90° | 85% | Dupont Nafion 315 Laminate |
| 6 | 4 Mg/Cm$^2$ (Ru 25% Ir - 25% Ta)$O_x$ | 4 Mg/Cm$^2$ Pt Black | ~5M (290 g/L) | 300 | 3.5–3.6 | 90° | 86% | Dupont Nafion 315 Nafion |
| • 7 | 6 Mg/Cm$^2$ (Ru $O_x$-Graphite) | 2 Mg/Cm$^2$ Pt Black | ~5M (290 g/L) | 300 | 3.0 | 90° | 89% | Dupont Nafion 315 Nafion |
| 8 | 6 Mg/Cm$^2$ (Ru $O_x$) | 4 Mg/Cm$^2$ Pt Black | ~5M (290 g/L) | 300 | 3.4 | 80° | 83% | Dupont 1500 EW Nafion |
| 9 | 6 Mg/Cm$^2$ (Ru - 5 Ir)$O_x$ | 4 Mg/Cm$^2$ Pt Black | ~5M (290 g/L) | 300 | 3.4–3.7 | 90° | 73% | Dupont 1500 EW Nafion |
| 10 | 2 Mg/Cm$^2$ (Ir $O_x$) | 4 Mg/Cm$^2$ Pt Black | ~5M (290 g/L) | 300 | 3.1–3.5 | 90° | 80% | Dupont Nafion 315 Laminate |
| 11 | 2 Mg/Cm$^2$ (Ir $O_x$) | 4 Mg/Cm$^2$ Pt Black | ~5M (290 g/L) | 300 | 3.2–3.6 | 90° | 65% | Dupont Nafion 315 Laminate |

A cell similar to Cell No. 7 of Table I was constructed and operated at 90° C. in a saturated brine feed. The cell potential (V) as a function of current density (ASF) was observed and is shown in Table II.

TABLE II

| Cell Voltage (V) | Current Density (ASF) |
|---|---|
| 3.2 | 400 |
| 2.9 | 300 |
| 2.7 | 200 |
| 2.4 | 100 |

This data shows that cell operating potential is reduced as current density is reduced. Current density vs. cell voltage is, however, a trade-off between operating and capital costs of a chlorine electrolysis. It is significant, however, that even at very high current densities (300 and 400 ASF), significant improvements (in the order of a volt or more) in cell voltages are realized in the chlorine generating process of the instant invention.

Table III illustrates the effect of cathodic current efficiency on oxygen evolution. A cell having Teflon-bonded reduced noble metal oxides catalytic anodes and cathodes embedded in a cationic membrane were operated at 90° C. with a saturated brine concentration, with a current density of 300 ASF and a feed rate of 2–5 CC/Min/in$^2$ of electrode area. The volume percent of oxygen in the chlorine was determined as a function of cathodic current efficiency.

TABLE III

| Cathodic Current Efficiency (%) | Oxygen Evolution (Volume %) |
|---|---|
| 89 | 2.2 |
| 86 | 4.0 |
| 84 | 5.8 |
| 80 | 8.9 |

Table IV illustrates the controlling effect that acidifying the brine has on oxygen evolution. The volume percent of oxygen in the chlorine was measured for various concentration of HCl in the brine.

TABLE IV

| Acid (HCl) Concentration (M) | Oxygen Volume % |
|---|---|
| 0.5 | 2.5 |
| 0.75 | 1.5 |
| 0.10 | 0.9 |
| 0.15 | 0.5 |
| 0.25 | 0.4 |

It is clear from this data that oxygen evolution due to electrochemical oxidation of the back migrating $OH^-$ is reduced by preferentially reacting the $OH^-$ chemically with $H^+$ to form $H_2O$.

A cell similar to Cell No. 1 of Table I was constructed and operated with a saturated NaCl feedstock acidified with 0.2M HCl and at 300 ASF. The cell voltage was measured at various operating temperatures from 35°–90° C.

A cell similar to Cell No. 7 of Table I was constructed and operated with 290 g/L (~5M)/L NaCl stock (not acidified) at 200 ASF. The cell voltage was measured at various operating temperatures from 35°–90° C. The data was normalized for 300 ASF.

TABLE V

| Cell No. 1 Voltage | Cell No. 7 Voltage Normalized to 300 ASF (200 ASF Data) | Temperature °C. |
|---|---|---|
| 3.65 | 3.50 (3.15) | 35° |
| 3.38 | 3.30 (2.98) | 45° |
| 3.2 | 3.20 (2.9) | 55° |
| 3.15 | 3.12 (2.78) | 65° |
| 3.10 | 3.05 (2.72) | 75° |
| 3.05 | 2.97 (2.65) | 85° |
| 3.02 | 2.95 (2.63) | 90° |

This data shows that the best operating voltage is obtained in the 80°–90° C. range. It is to be noted, however, that even at 35° C., the voltage with the instant process and electrolyzer is at least 0.5 volts better than prior art chlrine electrolyzers operating at 90° C.

A number of cells were constructed with composite membranes having anion rejecting cathode side barrier layers in the form of a chemically modified sulfonamide layers. The membranes were 7.5 mil membranes of the type sold by E. I. Dupont under its trade name Nafion. The cathode side of the membrane was modified to a depth of 1.5 mils by reacting with ethylenediamine (EDA) to form the sulfonamide barrier layer to enhance hydroxyl rejection and minimize back migration of caustic to the anode side. An anode consisting of (Ru 25

Ir) $O_x$ particles with a twenty percent (20%) T-30 Teflon binder with a noble metal loading of 6 milligrams/$Cm^2$ was bonded to the membrane. A cathode of platinum black particles mixed with fifteen percent (15%) T-30 binder with a loading of 4 Mgs/Cms was bonded to the other side of the membrane.

A brine solution having a concentration of 280 to 315 gL/L of NaCl was supplied to the anode chamber and distilled water was supplied to the cathode chamber. The cells were operated at 304 amps per sq. ft. current density and temperature in the range of 85°–90° C., and the following cell voltages, caustic concentrations and cathodic efficiencies were realized with the composite anion rejecting barrier layer.

TABLE VI

| Cell | Cell Voltage | Temp. °C. | M NaOH | % Cathodic Efficiency |
|---|---|---|---|---|
| 1 | 2.68 | 85° | 5.1 | 89.6 |
| 2 | 2.78 | 89° | 4.8 | 87.6 |
| 3 | 2.76 | 90° | 4.8 | 91.6 |

This data clearly shows that the use of a composite membrane having a cathode side anion rejecting barrier layer of the chemically modified, sulfonamide type results in substantial improvements in cathodic current efficiencies without affecting the voltage efficiency of the process. Current efficiencies around 88 to approximately 92% are realized as with a process carried out in a cell of this type. This clearly indicates that the use of such a membrane with bonded electrodes results in substantial improvements of current efficiency and hence in the overall economies of the process.

When the NaCl electrolysis is carried out in a cell in which both electrodes are bonded to the surface of an ion transporting membrane, the maximum improvement is achieved. However, improved process performance is achieved for all structures in which at least one of the electrodes is bonded to the surface of the ion transporting member (hybrid cell). The improvement in such a hybrid structure is somewhat less than is the case with both electrodes bonded. Nevertheless, the improvement is quite significant (0.3–0.5 volts better than the voltage requirements for known processes).

A number of cells were constructed and brine electrolysis carried out to compare the results in a fully bonded cell (both electrodes) with the results in hybrid cell constructions (anode only bonded and cathode only bonded) and with results a prior art non-bonded construction (neither electrode bonded). All of the cells were constructed with membranes of Nafion 315, the cell was operated at 90° C. with a brine feedstock of approximately 290 g/L. The bonded electrode catalyst loadings were 2 g/$ft^2$ at the cathode for Pt Black and 4 g/$ft^2$ at the anode for $RuO_x$-graphite and $RuO_x$. The current efficiency at 300 ASF was essentially the same for all cells (84–85% for 5M NaOH). Table VII shows the cell voltage characteristics for the various cells:

TABLE VII

| Cell | Anode | Cathode | Cell Voltage (V) at 300 ASF |
|---|---|---|---|
| 1 | Ru-Graphite (Bonded) | Pt Black (Bonded) | 2.9 |
| 2 | Platinized Niobium Screen (Not Bonded) | Pt Black (Bonded) | 3.5 |
| 3 | Platinized Niobium Screen (Not Bonded) | Pt Black (Bonded) | 3.4 |
| 4 | Ru-Graphite (Bonded) | Ni Screen (Not Bonded) | 3.5 |

TABLE VII-continued

| Cell | Anode | Cathode | Cell Voltage (V) at 300 ASF |
|---|---|---|---|
| 5 | Ru $O_x$ (Bonded) | Ni Screen (Not Bonded) | 3.3 |
| 6 | Platinized Niobium Screen (Not Bonded) | Ni Screen (Not Bonded) | 3.8 |

It can be seen that the cell voltage of the fully Teflon-bonded Cell No. 1 is almost a volt better than the voltage for the prior art, completely non-Teflon bonded, control Cell No. 6. Hybrid cathode bonded cells 2 and 3 and hybrid anode bonded cells 4 and 5 are approximately 0.4–0.6 volts worse than the fully Teflon-bonded cell but still 0.3–0.5 volts better than the prior art processes which are carried out in a cell without any Teflon bonded electrodes.

It will be appreciated that a vastly superior process for generating chlorine from brine has been made possible by reacting the brine anolyte and the water catholyte at catalytic electrodes bonded directly to and embedded in the cationic membrane to evolve chlorine at the anode and hydrogen and high purity caustic at the cathode. By virtue of this arrangement, the catalytic sites in the electrodes are in direct contact with the membrane and the acid exchanging radicals in the membrane resulting in a much more voltage efficient process in which the required cell potential is significantly better (up to a volt or more) than known processes. The use of highly effective fluorocarbon bonded reduced noble metal oxide catalysts, as well as fluorocarbon graphite-reduced noble metal oxide catalysts with low overvoltages, further enhance the efficiency of the process.

While the instant invention has been shown in connection with a preferred embodiment thereof, the invention is by no means limited thereto, since other modifications of the instrumentality employed and the steps of the process may be made and fall within the scope of the invention. It is contemplated by the appended claims to cover any such modifications that fall within the true scope and spirit of this invention.

What we claim as new and desire to secure by Letters Patent of the United States is:

1. A method for generating chlorine which comprises electrolyzing an aqueous alkali metal chloride in a cell having an anode and a cathode separated by and in contact with an ion exchange diaphragm which is substantially impermeable to electrolyte flow therethrough wherein at least one of said anode and cathode comprises a mixture of particles of an electroconductive platinum group catalytic material and further includes particles of an electroconductive extender bonded to the membrane, said extender being a material other than a platinum group catalyst; by feeding alkali metal chloride to the anode and water to the cathode and maintaining an electrolyzing potential between said anode and cathode.

2. The method of claim 1 wherein said electroconductive catalytic material is a reduced noble metal oxide.

3. The method of claim 2 wherein said noble metal oxide is reduced oxide of ruthenium.

4. The method of claim 3 wherein said anode comprises said mixture and wherein the conductive extender includes graphite or titanium coated with platinum group metal or oxide thereof.

5. The method of claim 3 wherein said cathode comprises said mixture and wherein the conductive extender includes silver or gold.

6. The method of claim 5 wherein the mixture includes silver.

7. The method of claim 1 wherein said particles are bonded with a fluorocarbon polymer.

8. The method of claim 1 wherein said anode comprises said mixture and wherein the conductive extender includes graphite or titanium coated with platinum group metal or oxide thereof.

9. The method of claim 1 wherein said cathode comprises said mixture and wherein the mixture includess silver or gold.

10. The method of claim 1 wherein said extender is present in amount by weight of up to 50% of said mixture.

11. The method of claim 1, wherein said extender is present in amount by weight of 10–30% of the mixture.

12. The method for generating chlorine which comprises electrolyzing an aqueous alkali metal chloride in a cell having an anode and a cathode separated by and in contact with an ion exchange diaphragm which is substantially impermeable to electrolyte flow therethrough wherein at least one of said anode and cathode comprises a mixture of particles of an electroconductive platinum group catalytic material and further includes particles of an electroconductive extender bonded together, said extender being a material other than a platinum group catalyst; by feeding alkali metal chloride to the anode and water to the cathode and maintaining an electrolyzing potential between said anode cathode.

* * * * *